US005486647A

United States Patent [19]

Kay et al.

[11] Patent Number: 5,486,647

[45] Date of Patent: Jan. 23, 1996

[54] CHORD IDENTIFYING METHOD FOR AUTOMATIC ACCOMPANIMENT USING KEYBOARD INSTRUMENT AND AUTOMATIC ACCOMPANIMENT FUNCTION EQUIPPED KEYBOARD INSTRUMENT USING THE SAME

[75] Inventors: Stephen R. Kay, 140 Madison Ave., Westfield, N.J. 07090; Athan Billias, Mountain View, Calif.; Yoshiyuki Igoshi, Tokyo; Naoki Hashida, Saitama, both of Japan

[73] Assignees: Stephen R. Kay, Westfield, N.J.; Korg Incorporated, Suginami, Japan

[21] Appl. No.: 265,837

[22] Filed: Jun. 24, 1994

[30] Foreign Application Priority Data

Jun. 25, 1993 [JP] Japan ..... 5-155344

[51] Int. Cl.[6] ..... G10H 1/38; G10H 1/42

[52] U.S. Cl. ..... 84/635; 84/637; 84/DIG. 12; 84/DIG. 22

[58] Field of Search ..... 84/609–614, 634–638, 84/DIG. 12, DIG. 22

[56] References Cited

U.S. PATENT DOCUMENTS 4,192,212 3/1980 Yamaga et al. ..... 84/DIG. 22
4,381,689 5/1983 Oya ..... 84/DIG. 22

*Primary Examiner*—Stanley J. Witkowski
*Attorney, Agent, or Firm*—Pollock, Vande Sande & Priddy

[57] ABSTRACT

Left- and right-hand keystroke windows $X_L$ and $X_H$ are decided in accordance with the positions of player's left and right hands pressing keys. When the number of pressed keys in either one of the windows $X_L$ and $X_H$ are larger than a predetermined value, that window is decided to be used as a chord identifying window, and on the basis of a combination of pressed keys in the chord identifying window, an accompaniment chord is decided for automatic accompaniment.

14 Claims, 7 Drawing Sheets

$L = 0$
$H = 11$
$Z = [(0 + 11) \div 2] = 5$
$0 \leqq X_L < 5$
$5 \leqq X_H \leqq 11$
CHORD : INDEFINITE $L = 0$
$H = 10$
$Z = [(0 + 10) \div 2] = 5$
$0 \leqq X_L < 5$
$5 \leqq X_H \leqq 10$
$5 \leqq W_{COD} \leqq 10$ $L = 0$
$H = 11$
$Z = \lceil (0+11) \div 2 \rceil = 5$
$0 \leqq X_L < 8$
$3 \leqq X_H \leqq 11$
$0 \leqq W_{COD} \leqq 11$ $L = 0$
$H = 10$
$Z = \lceil (0+10) \div 2 \rceil = 5$
$0 \leqq X_L < 8$
$2 \leqq X_H \leqq 10$
$0 \leqq W_{COD} \leqq 10$ $L = 0$
$H = 17$
$Z = \lceil (0+17) \div 2 \rceil = 8$
$0 \leqq X_L < 16$
$10 \leqq X_H \leqq 17$
$0 \leqq W_{COD} \leqq 16$ $L = 0$
$H = 17$
$Z = \lceil (0+17) \div 2 \rceil = 8$
$0 \leqq X_L < 8$
$1 \leqq X_H \leqq 17$
$1 \leqq W_{COD} \leqq 17$ C Minor 7th (11th)

$L = 0$ $H = 19$ $Z = \lceil (0 + 19) \div 2 \rceil = 9$ $0 \leqq X_L < 9$ $3 \leqq X_H \leqq 19$ $3 \leqq W_{COD} \leqq 19 \ (+ K_0)$

CHORD IDENTIFYING METHOD FOR AUTOMATIC ACCOMPANIMENT USING KEYBOARD INSTRUMENT AND AUTOMATIC ACCOMPANIMENT FUNCTION EQUIPPED KEYBOARD INSTRUMENT USING THE SAME

BACKGROUND OF THE INVENTION

The present invention relates to a chord identifying method for automatic accompaniment which uses a keyboard instrument and an automatic accompaniment function equipped keyboard instrument which utilizes the chord identifying method.

Conventionally, when a keyboard instrument equipped with an automatic accompaniment function is placed in an automatic accompaniment mode, a split or dividing point is set at a proper note on the keyboard; the sound range lower than the split point, for example, is used to identify or recognize chords for accompaniment and the upper sound range to play melodies or the like. In the chord identifying sound range, even a single keystroke is regarded as an accompaniment chord designating or specifying input and an accompaniment chord is identified accordingly.

In FIG. 1 there is shown in block form a conventional keyboard instrument with the automatic accompaniment function. Reference numeral 11 denotes a keyboard, which is connected to a keystroke detecting part 12. The keystroke detecting part 12 provides its detected output to a sound source controller 14 and a chord identifying part 13. That is, in the automatic accompaniment mode, the sound range at the lower side of the center key of the keyboard 11, for instance, is set as an accompaniment chord identifying sound range and every keystroke detected signal in this sound range is provided to the chord identifying part 13.

A keystroke detected signal in the other sound range is fed directly to the sound controller 14, which controls a sound source 17 to generate a sound signal of the note of the pressed key, and the sound signal is input into an amplifier/speaker system 18 to produce the corresponding note.

With the conventional keyboard instrument, even if only one key is pressed, the chord identifying part 13 identifies an accompaniment chord including the note of the pressed key and provides the identified chord to an accompaniment pattern selective readout part 15. In an accompaniment pattern memory 16 there are stored a plurality of accompaniment patterns of original chords in predetermined accompaniment rhythms that match respective kinds of music. The accompaniment pattern selective readout part 15 converts the original chord of the accompaniment rhythm pattern, read out of the accompaniment pattern memory 16, to the chord specified by the chord identifying part 13 and provides it as an accompaniment chord control signal to the sound controller 14. The accompaniment chord control signal is also used to control the sound source 17 and the resulting accompaniment tone is also produced from the amplifier/speaker system 18.

In the traditional automatic accompaniment device, as described above, the chord identifying part 13 identifies an accompaniment chord in response to even a single keystroke in the sound range specified to identify or recognize chords for accompaniment. Hence, this sound range cannot be used for playing melodies or the like, except accompaniment rhythms. This leads to a defect that the base line, for instance, cannot be played to accompaniment in the low sound range just like melodies; thus, the automatic accompaniment feature rather constitutes a nuisance to skilled players.

In an automatic accompaniment device, which is proposed as a solution to this problem in Japanese Pat. Appln. No. 254382/72, entitled "Automatic Accompaniment Device," the number of keys pressed in the chord identifying sound range for accompaniment is counted and the keystroke detection outputs are accepted or recognized as keystroke inputs of an accompaniment chord when the number of keys pressed at the same time is equal to or larger than a preset value.

With this conventional automatic accompaniment device, the number of pressed keys, even if all in the chord identifying range for accompaniment, is smaller than the preset value, the keystroke detection outputs are not accepted as the keystroke inputs of an accompaniment chord. Hence, the base line can be played in the low sound range like a melody.

In the previously proposed automatic accompaniment device, however, the split point between the chord identifying sound range for accompaniment and the non-chord-identifying sound range is fixed; so that when pressed keys are those spreading across the split or dividing point, no chord identification is allowed. Furthermore, since the chord identifying sound range for accompaniment is preset and fixed, it is impossible to switch the sound range from the low to the higher range or both of the low and high sound ranges to the chord identifying one during playing.

SUMMARY OF THE INVENTION

It is therefore an object of the present invention to provide a method which ensures correct identification or recognition of chords in whatever situation of keys being pressed, without fixing the chord identifying sound range for accompaniment and the non-chord identifying one and a keyboard instrument equipped with an automatic accompaniment function which utilizes the chord identifying method.

The basic principle of the present invention resides in that keystroke windows for the right and left hands are set in accordance with the positions of player's hands on the keyboard. The keystroke windows change or move as the hands move or shift on the keyboard.

According to a first aspect of the present invention, the center key between the lowest and highest notes of keys to be pressed by left and right hands, respectively, is determined as a split or dividing point where to split the keyboard into a keystroke window by the left hand (hereinafter referred to as a left-hand keystroke window) and a keystroke window by the right hand (hereinafter referred to as a right-hand keystroke window).

According to a second aspect of the present invention, the right-hand keystroke window is defined by a key of the lowest note among the keys being pressed and a higher one of the center key defined by the lowest and highest notes of the keys being pressed and a key of a note higher than the lowest note in excess of a predetermined value. The right-hand keystroke window is defined by the key of the highest note and the center key or a key of a note lower than the highest note in excess of a predetermined value.

According to the second aspect mentioned above, the left- and right-hand keystroke windows are allowed to overlap with each other—this is particularly effective when the hands on the keyboard are close together.

According to a third aspect of the present invention, the keystroke concentration in each keystroke window is computed and the both windows are controlled or adjusted so that the window of the higher concentration is made larger than the other window. According to this aspect, the window of the higher keystroke concentration has a greater probability of a key being pressed to play a chord for accompaniment than the keystroke window of lower concentration. Thus, chords for accompaniment can be identified appropriately by setting the window of higher concentration larger than the other window.

According to a fourth aspect of the present invention, that one of the right- and left-hand keystroke windows, defined according to any one of the first through third aspects, in which the number of pressed keys is larger than a predetermined value is determined as a chord identifying window.

According to a fifth aspect of the present invention, there is provided a keyboard instrument equipped with an automatic accompaniment function which identifies chords for accompaniment by the method according to the fourth aspect and performs automatic accompaniment accordingly.

In the automatic accompaniment function equipped keyboard instrument according to the fifth aspect, the right- and left-hand keystroke windows change with a change in the positions of keys being pressed. This ensures the determination of a correct or accurate chord identifying window regardless of the positions of the right and left hands on the keyboard.

According to a sixth aspect of the present invention, the lowest note among the keys being pressed is also used to identify a chord, regardless of whether the chord identifying window is at the side of the low or high sound range; this permits the determination of the lowest note in chords for accompaniment, ensuring accurate identification of accompaniment chords.

DESCRIPTION OF THE PREFERRED EMBODIMENTS

Figure 2:
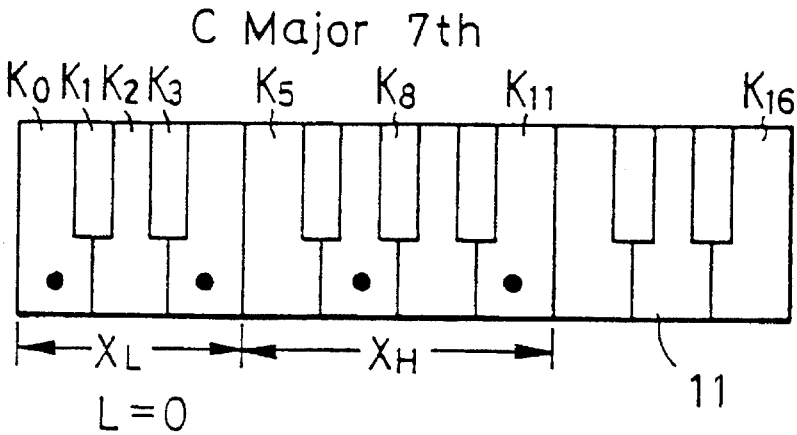
FIG. 2 is a schematic diagram of a keyboard for explaining an embodiment of the present invention according to the first aspect thereof.

In FIG. 2 there is illustrated an embodiment according to the first aspect of the present invention. Reference numeral 11 denotes a keyboard and $K_0$ through $K_{16}$ indicate key numbers given for each semitone. The keys $K_0$, $K_4$, $K_7$ and $K_{11}$, indicated by black circles, are keys being simultaneously pressed. This is the case of playing a chord C Major 7th (hereinafter abbreviated to $CM_7$).

According to the first aspect of the present invention, the split or dividing point between left- and right-hand keystroke windows $X_L$ and $X_H$ is set at a key (hereinafter referred to as a center key) in the middle between keys of the lowest and highest notes among the keys being simultaneously pressed. In the FIG. 2 embodiment, of the pressed keys indicated by the black circles, the key of the lowest note is $K_L=K_0$ and the key of the highest note is $K_H=K_{11}$. Here, the suffixes of these keys $K_0$ and $K_{11}$ are used to represent the lowest and highest notes by L=0 and H=11, respectively. Thus, the note Z of the key at the split point (which note will hereinafter be referred to as a center note) is $Z=\lceil (L+H)/2 \rceil=\lceil (0+11)/2 \rceil=5$, where the symbol $\lceil a \rceil$ represents a maximum integer which does not exceed a given real number a. Hence, the key $K_5$ is determined as the split point and the left-hand keystroke window $X_L$ is defined by $0 \leqq X_L < 5$ and the right-hand keystroke window $X_H$ by $5 \leqq X_H < 11$. The numbers of pressed keys in the left- and right-hand keystroke windows $X_L$ and $X_H$ thus determined are counted and the keystroke window in which the number of pressed keys is larger than a predetermined value M, for example, M=3, is judged as effective in the chord identification and decided to be a chord identifying window $W_{COU}$. When the both keystroke windows are judged effective, the entire region covered by the both windows is used as the chord identifying window $W_{COU}$. Based on keystrokes in the chord identifying window $W_{COU}$, chords are identified.

According to the first aspect described above, when the hands relatively stay apart on the keyboard, it is possible to achieve unerring chord identification, but when the hands are close together, a problem arises. Moreover, in the example of FIG. 2, the keystroke windows $X_L$ and $X_H$ each cover or contain only two keys. For example, when the number of keys for chord identification is set to 3, no chord identification is possible in either of the keystroke windows $X_L$ and $X_H$ in the FIG. 2 example.

Figure 3:
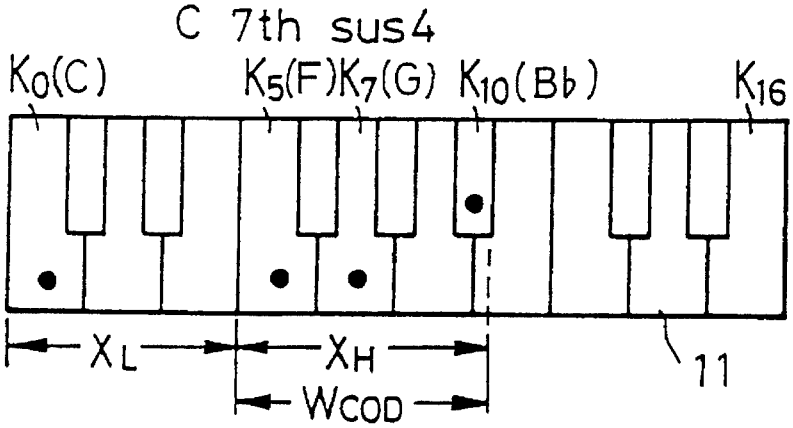
FIG. 3 is a schematic diagram of a keyboard for explaining a defect of the keyboard depicted in FIG. 2.

In the case of playing notes C, F, G, Bb (i.e., C 7th SUS4, hereinafter abbreviated to $C_7SUS4$) as shown in FIG. 3, the left-hand keystroke window $X_L$ covers only the key C, whereas the right-hand keystroke window $X_H$ covers keys F, G and Bb. If the number M of keys for chord identification is set to 3, only the right-hand keystroke window $X_H$ is qualified as a chord identifying window; in this example, however, the chord $C_7SUS4$ is erroneously identified as G minor 7th (hereinafter abbreviated to $Gm_7$).

To avoid this, according to the second aspect of the invention, minimum sound ranges from both of the lowest and highest notes of the keystroke windows $X_L$ and $X_H$ are predefined and when keys are simultaneously pressed by the hands close together, the both windows $X_L$ and $X_H$ are allowed to overlap each other to exclude the possibility of the above-mentioned misidentification.

That is, according to the second aspect of the present invention, the afore-mentioned center key of a note at the center of the sound range between the lowest and highest notes is determined; the sound range, which is defined by the lowest note and a higher one of the center note and a note which is higher than the lowest note by a predetermined number of keys, is determined to be the left-hand keystroke window $X_L$, and the sound range, which is defined by the highest note and a lower one of the center note and a note which is lower than the highest note by a predetermined number of keys, is determined to be the right-hand keystroke window $X_H$.

Figure 4:
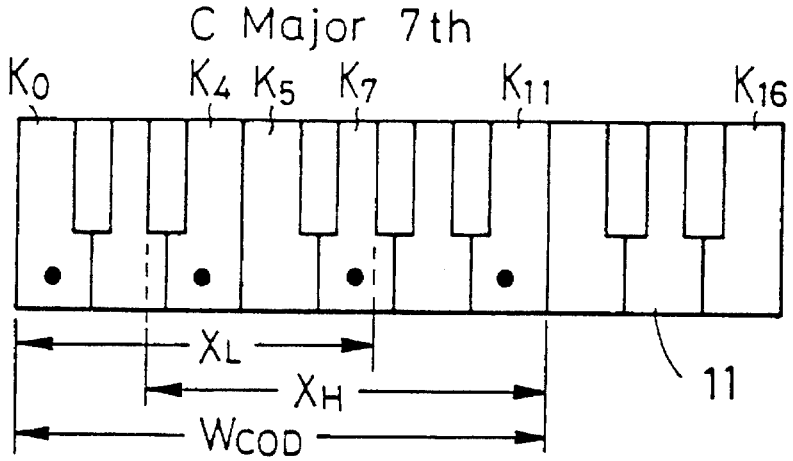
FIG. 4 is a schematic diagram of a keyboard for explaining an embodiment of the invention according to the second aspect thereof.

An embodiment of this method is shown in FIG. 4. In this embodiment:

(A) The lower limit of the left-hand keystroke window $X_L$ is L=0; and the upper limit of the window $X_L$ is a key $K_8$ of a higher one (0+8)=8 of the center note Z=5 (i.e., $K_5$) and a note (L+8). Hence, the window $X_L$ is defined by $0 \leqq X_L < 8$. (Here, the above-said predetermined number is set to 8.)

(B) The upper limit of the right-hand keystroke window $X_H$ is H=11; and the lower limit of the window $X_H$ is a key $K_3$ of a lower one (11−8=3) of the center note Z=5 and a note (H−8). Hence, the window $X_H$ is defined by $3 \leqq X_H < 11$.

According to the FIG. 4 embodiment, the windows $X_L$ and $X_H$ each cover a minimum of 8 notes or keys. By this, in the afore-mentioned case of the chord C Major 7th, the notes or keys C, E and G are admitted into the left-hand window $X_L$, whereas the right-hand window $X_H$ contains the keys E, G and B. Consequently, either window is usable for identification of chords; in this case, the both windows $X_L$ and $X_H$ are combined into a single window $W_{COD}$.

Figure 5:
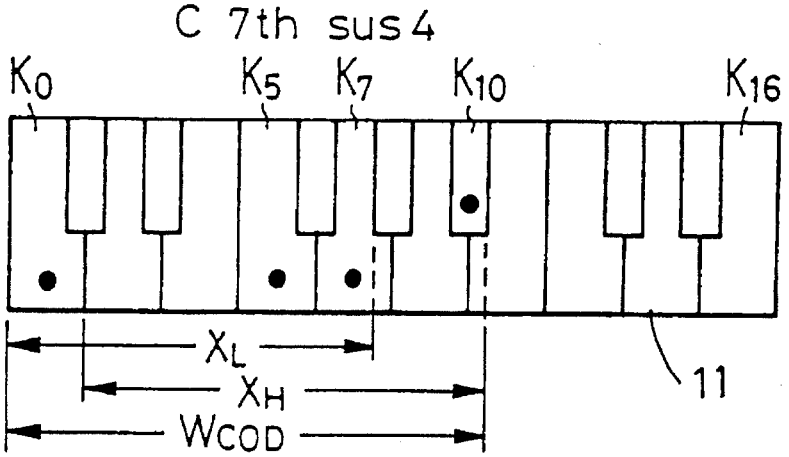
FIG. 5 is a schematic diagram of a keyboard for explaining another example according to the second aspect of the invention.

FIG. 5 shows another example for explaining the second aspect of the invention. In this example, keys are shown to have been pressed to play the chord $C_7$SUS4. According to the second aspect, the left-hand window $X_L$ has an upper limit of 0+8=8 and a lower limit of 0, and hence is defined by $0 \leqq X_L < 8$; the right-hand window $X_H$ has an upper limit of 10 and a lower limit of 10−8=2, and hence is defined by $2 \leqq X_H \leqq 10$.

Thus, the left- and right-hand windows $X_L$ and $X_H$ both contains three keys, and hence work well for identification of chords; therefore, the chord identifying window $W_{COD}$ is defined by $0 \leqq W_{COD} \leqq 10$. This window permits correct chord identification.

The third aspect of the present invention is an improvement over the method according to the second aspect for setting an overlapping of the windows $X_L$ and $X_H$. According to the third aspect, the concentration of pressed keys with respect to the lowest note among them and the concentration of pressed keys with respect to the highest note among them are computed, and the window of the higher concentration is set larger than the other window.

The concentration (or the degree of proximity) $C_L$ of simultaneously pressed keys with respect to the lowest note L and the concentration $C_H$ of simultaneously pressed keys with respect to the highest note H are computed. These concentrations are defined, as mentioned below, by the reciprocal of the sum of distances from the lowest note to the notes of the respective pressed keys (that is, the number of semitones or keys) and by the reciprocal of the sum of distances from the highest note H to the notes of the respective pressed keys. Concentration $C_L$ with respect to the lowest note L:

$$C_L = 1/\{\Sigma(X_n - L)\}$$

Concentration $C_H$ with respect to the highest note H:

$$C_H = 1/\{\Sigma(H - X_n)\}$$

($X_n$: all pressed key numbers 0, 1, 2, . . . )

The window of the larger concentration $C_L$ or $C_H$ can be regarded as containing notes of pressed keys closer together than in the other window. In other words, the high concentration indicates a strong possibility of an accompaniment chord having been played in the window concerned. For this reason, according to the third aspect, the following conditions are set to make the window of higher concentration larger than the window of lower concentration.

For example:

(A) When $C_L > C_H$ (that is, when the concentration on the L side is higher),

Left-hand window lower limit=L upper limit=Z or (L+P), whichever is greater;

Right-hand window lower limit=Z or (L+Q), whichever is greater upper limit=H (B) When $C_H \geqq C_L$ (that is, when the concentration on the H side is higher), Left-hand window lower limit=L upper limit=Z or (H−Q), whichever is smaller;

Right-hand window lower limit=Z or (H−P), whichever is smaller upper limit=H

Here, P is greater than 12 (one octave), for example, 16 and Q is smaller than 12, for example, 10.

With the use of the conditions A and B, it is possible to accurately separate the right- and left-hand windows even when the hands are close together. When the hands are sufficiently apart, the windows can be separated accurately by the method according to the first aspect.

Figure 6:
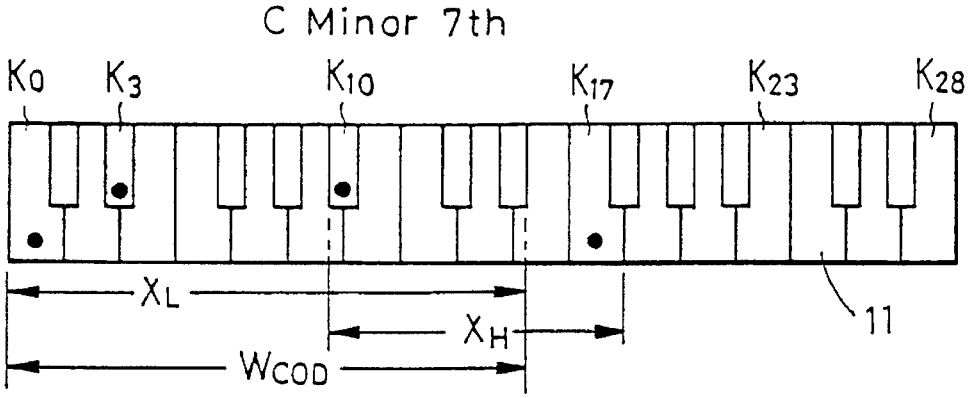
FIG. 6 is a schematic diagram of a keyboard for explaining an embodiment of the present invention according to the third aspect thereof.
Figure 7:
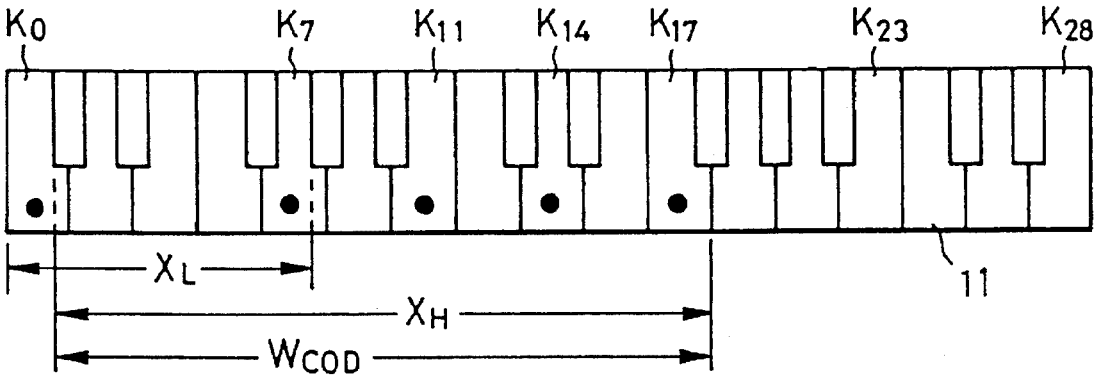
FIG. 7 is a schematic diagram of a keyboard for explaining another example according to the third aspect of the invention.

FIGS. 6 and 7 illustrate embodiments according to the third aspect. In the example of FIG. 6, keys are shown to have been pressed to play the chord $Cm_7$. In this instance, the lowest note L is L=0, the highest note H is H=17 and the center note Z is $Z = \lceil (0+17) \div 2 \rceil = 8$. The concentrations $C_L$ and $C_H$ of keys with respect to the lowest and highest notes, respectively, are given as follows:

$$-C_L = 1/\{(0-0)+(3-0)+(10-0)+(17-0)\} = 1/30$$

$$C_H = 1/\{(17-17)+(17-10)+(17-3)+(17-0)\} = 1/38$$

Therefore, in this example, $C_L$ is larger than $C_H$; setting P=16 and Q=10 and applying the condition A, Left-hand window lower limit=0 upper limit=0+16

Hence, $0 \leqq X_L < 16$.

Right-hand window lower limit=0+10 upper limit=17

Hence, $10 \leqq X_H \leqq 17$.

In this example, since the left-hand window $X_L$ contains three pressed keys, the chord identifying window $W_{COD}$ is defined by $0 \leqq W_{COD} < 16$.

In the FIG. 7 example, keys are shown to have been pressed to play the chord $G_7$. In this case, since L= 0, H=17 and $Z = \lceil (0+17) \div 2 \rceil = 8$, the concentrations $C_L$ and $C_H$ are given as follows:

$$C_L = 1/\{(0-0)+(7-0)+(11-0)+(14-0)+(17-0)\} = 1/49$$

$$C_H = 1/\{(17-17)+(17-14)+(17-11)+(17-7)+(17-0)\} = 1/36$$

Accordingly, the concentration $C_L$ is smaller than $C_H$; applying the condition B, Left-hand window: lower limit=0 upper limit=8

Therefore, $0 \leqq X_L < 8$.

Right-hand window:lower limit=17−16=1 upper limit=17 Therefore, $1 \leqq X_H \leqq 17$.

In this example, the right-hand window $X_H$ contains four pressed keys, and hence is determined to be used as the chord identifying window $W_{COD}$.

The method whereby the window containing three or more pressed keys is determined as the chord identifying window $W_{COD}$ is the chord identifying window determining method according to the fourth aspect. While in this example, the number of keys for identification of chords is described to be "3," the number of keys can be freely set by players. Incidentally, the numerical values 8, 10 and 16 in (L+8), (H−8) and (L+16), (L+10), (H−10), (H−16) in the above-described embodiments according to the second and third aspects of the invention are experimental values and are not theoretically supported; therefore, these values are not limited specifically thereto.

Figure 1:
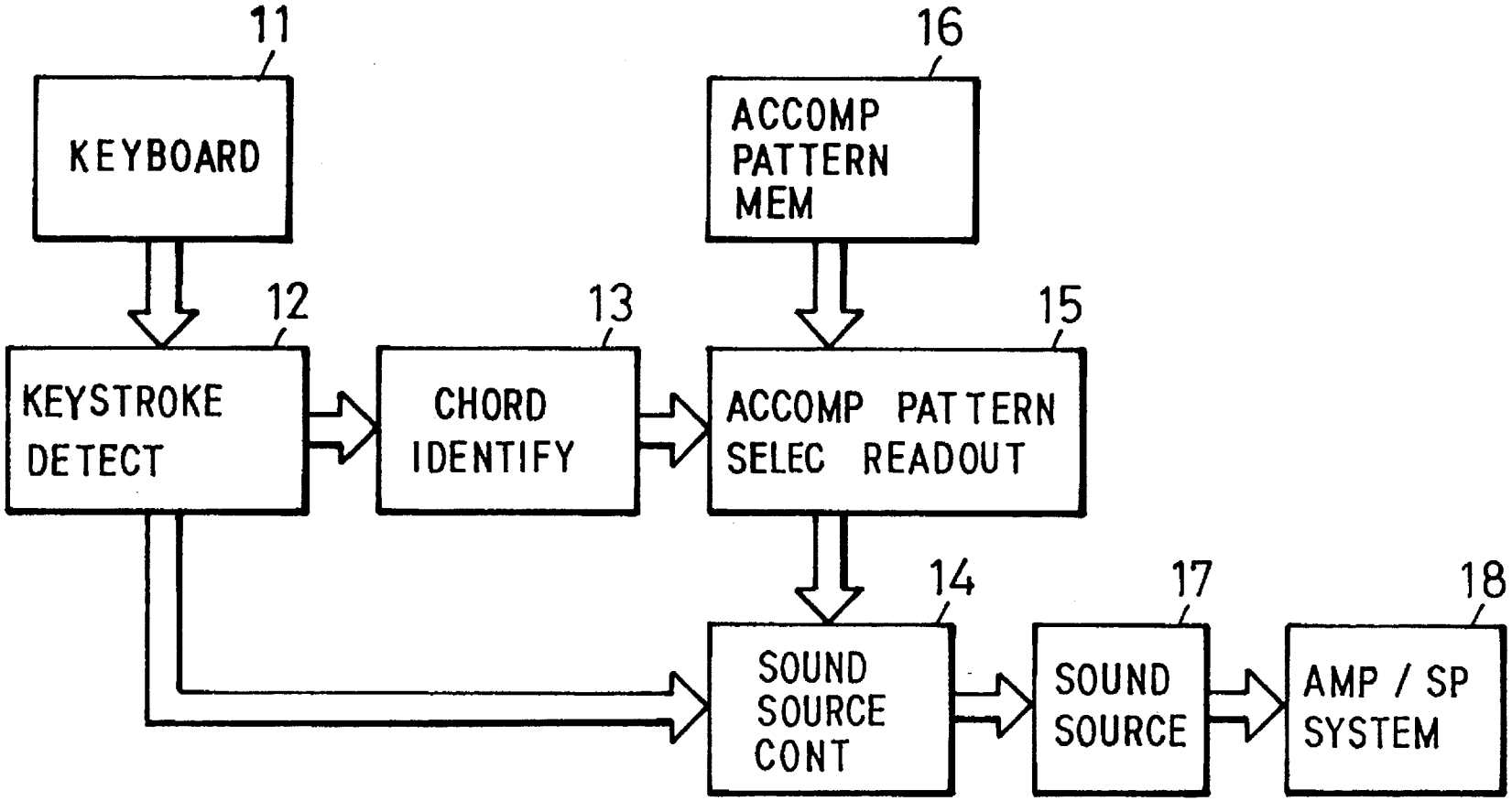
FIG. 1 is a block diagram showing a conventional keyboard instrument equipped with an automatic accompaniment function.
Figure 8:
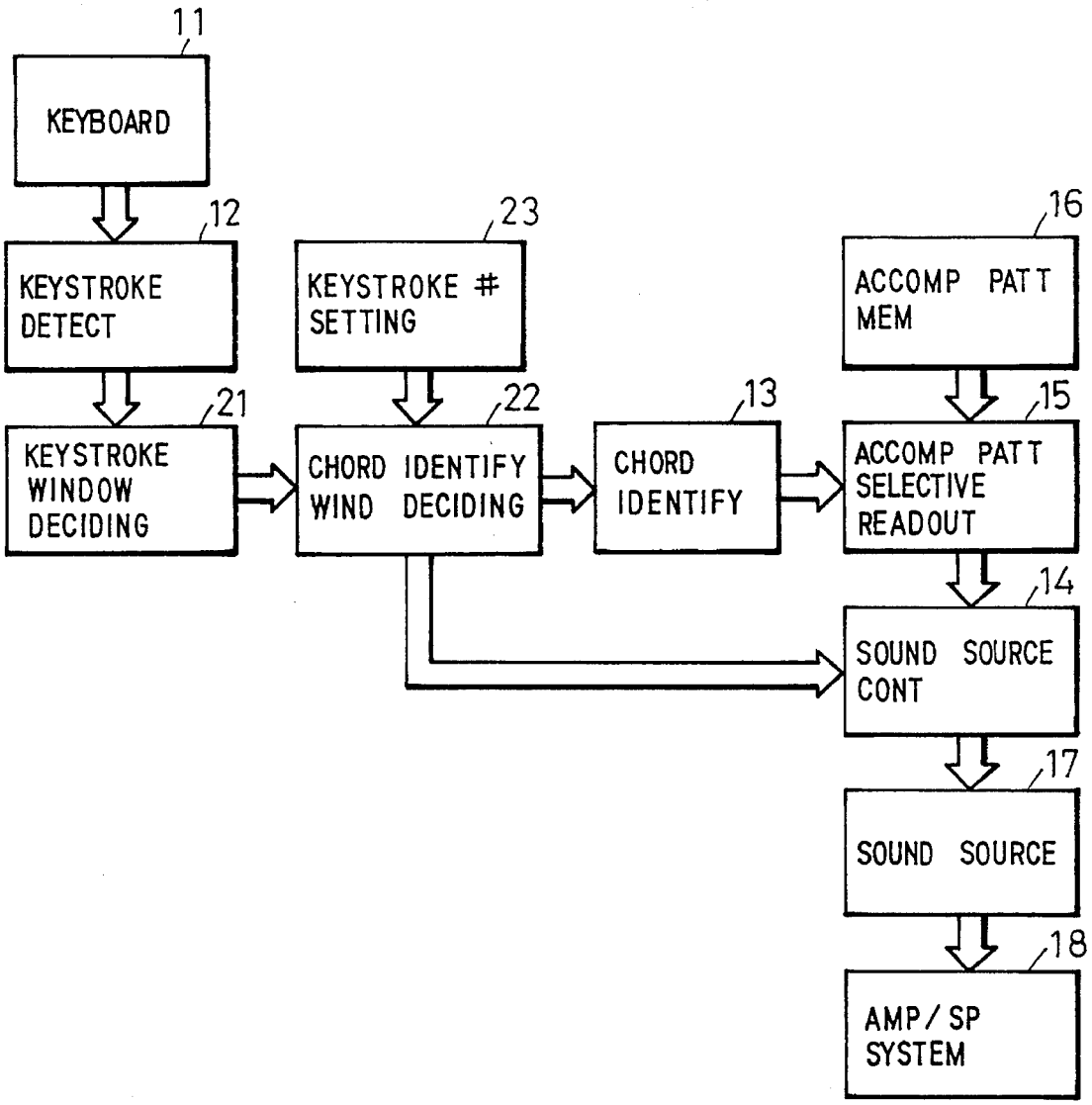
FIG. 8 is a block diagram illustrating an embodiment of the automatic accompaniment function equipped keyboard instrument according to the fifth aspect of the present invention.

FIG. 8 illustrates in block form an embodiment of the automatic accompaniment function equipped keyboard instrument of the present invention which implements any of the above-described methods according to the respective aspect of the invention. The automatic accompaniment function equipped keyboard instrument of the present invention features a keystroke window decision part 21 and a chord identifying window deciding part 22 added to the conventional automatic accompaniment function equipped keyboard instrument of FIG. 1. In this embodiment, a keystroke number setting part 23 is also provided.

The keystroke signal detected by the keystroke detecting part 12 is fed to the keystroke window deciding part 23, wherein the left- and right-hand windows $X_L$ and $X_H$ are decided by any one of the methods described previously with respect to FIGS. 2 through 7 or a combination thereof. Upon deciding the windows $X_L$ and $X_H$, the keystroke signal is fed to the chord identifying window deciding part 22, wherein it is determined which window contains pressed keys of the number equal to or greater than M set in the keystroke number setting part 23 for identification of chords. For example, when M= 3, the number of keys in each of the windows $X_L$ and $X_H$ is counted; the window containing three or more keys is decided as the chord identifying window $W_{COD}$ and the keystroke signal is provided to the chord identifying part 13 for chord identification. For instance, when the pressed keys in the chord identifying window $W_{COD}$ are C, E and Bb, the chord is recognized to be $C_7$, and when the pressed keys are A, C, Eb and G, the chord is recognized to be $Am_7$(b5). Such chord recognition or identification can easily be done based on known musical theories.

Figure 9:
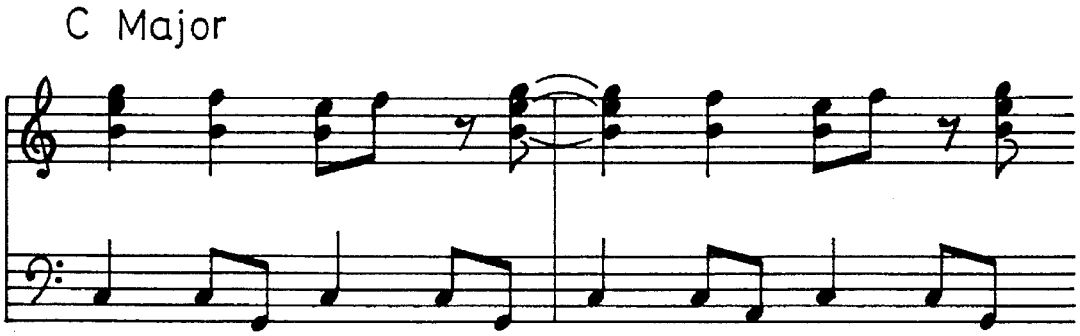
FIG. 9 is a diagram showing, as a score, an example of a pattern stored in an accompaniment pattern memory.
Figure 10A:
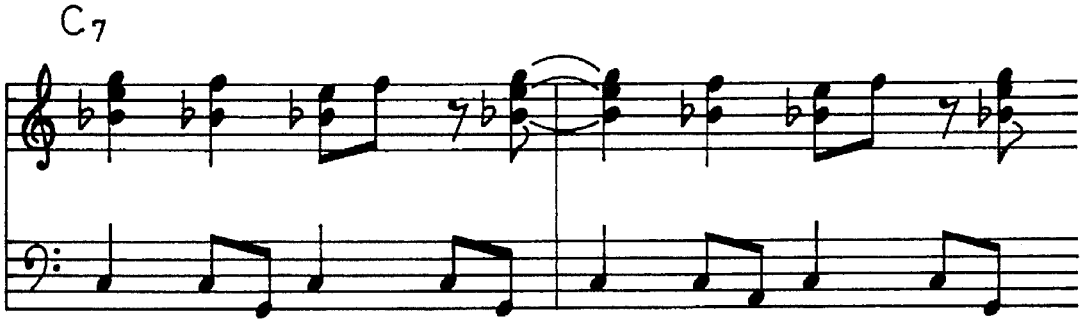
FIG. 10A is a diagram showing, as a score, a pattern of a chord $C_7$ converted from the pattern shown in FIG. 9.
Figure 10B:
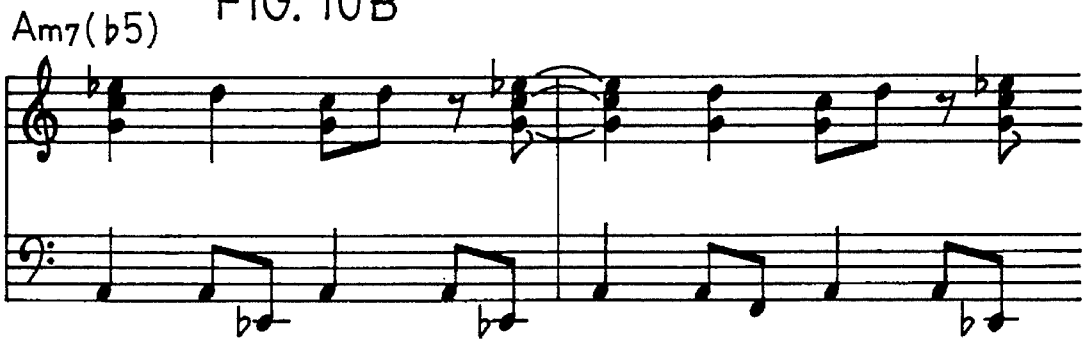
FIG. 10B is a diagram showing, as a score, a pattern of a chord $Am_7(b5)$ converted from the pattern of FIG. 9.

When the chord is thus identified, the accompaniment pattern selective readout part 15 converts the accompaniment pattern (a pattern representing, by a predetermined original chord, a rhythm pattern that matches the kind of the music being played), read out of the accompaniment pattern memory 16, to the identified chord, generating an accompaniment chord control signal. The accompaniment chord control signal is applied to the sound source controller 14, by which each tone source (not shown) in the sound source 17 is controlled to operate at the frequency corresponding to the specified pitch. In consequence, the sound source 17 generates an accompaniment tone signal which varies with the accompaniment pattern, and the accompaniment tone signal is fed to the amplifier/speaker system 18. FIG. 9 shows only two bars of an example of one of many accompaniment patterns stored in the pattern memory 16; in practice, accompaniment patterns are usually described about 16 bars long. In the FIG. 9 example, the accompaniment pattern is described in the key of C Majour. For example, when the pressed keys in the chord identifying window are C, B and B flat, the chord is identified to be $C_7$ and the accompaniment pattern of C Majour shown in FIG. 9 is converted to an accompaniment pattern of $C_7$ as shown in FIG. 10A. Shown in FIG. 10B is an accompaniment pattern converted from the FIG. 9 accompaniment of C Majour when the identified chord is $Am_7$(flat 5).

Incidentally, a keystroke signal which is not specified for the chord identifying window is applied directly from the chord identifying window deciding part 22 to the sound source controller 14, from which it is produced as a note of a melody from the amplifier/speaker system 18.

Figure 11:
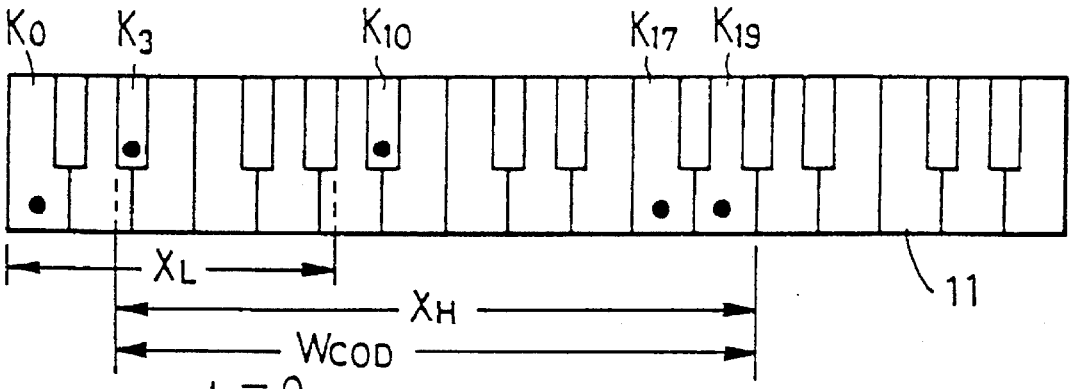
FIG. 11 is a schematic diagram of a keyboard for explaining an embodiment according to the sixth aspect of the present invention.

According to the sixth aspect of the present invention, when the keystroke signal for chord identification use is applied from the chord identifying window deciding part 22 to the chord identifying part 13, the signal of the key of the lowest note among the simultaneously pressed keys is also provided to the chord identifying part 13 even if the left-hand keystroke window $X_L$ is not designated as the chord identifying window. FIG. 11 shows an example of this scheme. In this example, keys are shown to have been pressed to play a chord $Cm_7$(11th). The lowest note L=0, the highest note H=18 and the center note $Z=\lceil (0+19)\div 2 \rceil=9$.

$$C_L=1/\{(0-0)+(3-0)+(10-0)+(17-0)+(19-0)\}= 1/49$$

$$C_H=1/\{(19-19)+(19-17)+(19-10)+(19-3)+(19-0)\} =1/46$$

Since $C_L<C_H$, the afore-mentioned condition B provides $0 \leqq X_L < 9$ $3 \leqq X_H \leqq 19$.

The window $X_H$ contains four pressed keys, and hence is decided to be used as the chord identifying window $W_{COD}$. That is, the lowest note among the notes of keys simultaneously pressed becomes the fundamental note in the accompaniment chord in many cases. Accordingly, to add the lowest note to the note for the identification of accompaniment chords at all times provides increased accuracy in the identification of accompaniment chords.

As described above, the present invention adopts a method according to which the left- and right-hand keystroke windows $X_L$ and $X_H$ are not fixed but are allowed to move in accordance with the positions of keys being pressed and either one of the windows $X_L$ and $X_H$ or combination thereof is used as the chord identifying window; therefore, the chord identification can be carried out accurately regardless of whether the right and left hands are close together or far apart.

Since no particular area of the keyboard is limited to accompaniment use, a player need not pay particular attention to such a limited area for accompaniment use. Thus, the present invention allows skilled to unskilled players to enjoy free automatic accompaniment; hence, the invention is of great utility when used in practice.

It will be apparent that many modifications and variations may be effected without departing from the scope of the novel concepts of the present invention.

What is claimed is:

1. A chord identifying method for automatic accompaniment wherein a chord is identified on the basis of simultaneously pressed keys of a keyboard instrument and the original chord of an accompaniment pattern read out from an accompaniment pattern memory in the course of playing said keyboard instrument is converted to said identified chord to generate an accompaniment tone signal, said method comprising the steps of:

detecting said simultaneously pressed keys of said keyboard instrument and detecting keys of the lowest and highest notes among said simultaneously pressed keys;

setting a dividing point at a center key between said keys of the lowest and highest notes;

deciding an area from said dividing point to said key of the lowest note to be used as left-hand keystroke window and an area from said dividing point to said key of the highest note as a right-hand keystroke window;

determining whether said keystroke windows are effective in the identification of chords and deciding an effective one of said keystroke windows to be used as a chord identifying window; and identifying chords on the basis of said pressed keys in said chord identifying window.

2. A chord identifying method for automatic accompaniment wherein a chord is identified on the basis of simultaneously pressed keys of a keyboard instrument and the original chord of an accompaniment pattern read out from an accompaniment pattern memory in the course of playing said keyboard instrument is converted to said identified chord to generate an accompaniment tone signal, said method comprising the steps of:

detecting said simultaneously pressed keys of said keyboard instrument and detecting keys of the lowest and highest notes among said simultaneously pressed keys;

determining a center key between said keys of the lowest and highest notes;

deciding a left-hand keystroke window which extends from said key of the lowest note to a higher one of said center key and a key higher in note than said key of the lowest note by a first predetermined number of keys and a right-hand keystroke window which extends from said key of the highest note to a lower one of said center key and a key lower in note from said key of the highest note by a second predetermined number of keys;

determining whether said keystroke windows are effective in the identification of chords and deciding an effective one of said keystroke windows to be used as a chord identifying window; and identifying chords on the basis of said pressed keys in said chord identifying window.

3. A chord identifying method for automatic accompaniment wherein a chord is identified on the basis of simultaneously pressed keys of a keyboard instrument and the original chord of an accompaniment pattern read out from an accompaniment pattern memory in the course of playing said keyboard instrument is converted to said identified chord to generate an accompaniment tone signal, said method comprising the steps of:

detecting said simultaneously pressed keys of said keyboard instrument and detecting keys of the lowest and highest notes among said simultaneously pressed keys;

computing the concentration of said pressed keys other than said key of the lowest note with respect to the latter and the concentration of said pressed keys other than said key of the highest note with respect to the latter;

deciding a sound range from said lowest note to a higher upper limit note to be used as a left-hand keystroke window and a sound range from said highest note to a lower limit note lower than said highest note to be used as a right-hand keystroke window, that one of said keystroke windows which is higher in said concentration being made larger than the other;

determining whether said keystroke windows are effective in the identification of chords and deciding an effective one of said keystroke windows to be used as a chord identifying window; and identifying chords on the basis of said pressed keys in said chord identifying window.

4. The method of claim 3, wherein said concentration is defined by the reciprocal of the sum of the numbers of keys from said lowest note to the notes of the other pressed keys and the reciprocal of the sum of the numbers of keys from said highest note to the notes of the other pressed keys.

5. The method of claim 3 or 4, which further comprises a step of deciding a center key between said keys of the lowest and highest notes; wherein when said concentration with respect to said lowest note is larger than said concentration with respect to said highest note, the lower limit of said left-hand keystroke window is set to said key of the lowest note, the upper limit of said left-hand keystroke window is set to a higher one of said center key and a key at a position higher than said key of the lowest note by a predetermined first number of keys exceeding one octave, the upper limit of said right-hand keystroke window is set to said key of the highest note and the lower limit of said right-hand keystroke window is set to a higher one of said center key and a key at a position lower than said key of the highest note by a predetermined second number of keys exceeding one octave; and wherein when said concentration with respect to said lowest note is smaller than said concentration with respect to said highest note, the lower limit of said left-hand keystroke window is set to said key of the lowest note, the upper limit of said left-hand keystroke window is set to a lower one of said center key and a key at a position lower than said key of the highest note by said second number of keys and the upper limit of said right keystroke window is set to a lower one of said center key and a key at a position lower than said key of the highest note by said first number of keys.

6. The method of claim 1, 2, or 3, wherein said chord identifying window deciding step is a step of counting the numbers of pressed keys in both of said left- and right-hand keystroke windows and deciding, as a chord identifying window, that one of said windows where said number of pressed keys is in excess of a predetermined value.

7. The method of claim 6, wherein regardless of which one of said left- and right-hand keystroke windows is decided as said chord identified window, said chord identifying step uses the note of a key which is the lowest among said pressed keys, for chord identification together with notes of said pressed keys in said chord identifying window.

8. An automatic chord accompaniment device comprising:

a keyboard instrument;

keystroke detecting means for detecting pressed keys of said keyboard instrument and for detecting the highest and lowest notes of said detected pressed keys;

keystroke window deciding means a left-hand keystroke window defined by a sound range from said lowest note to a first note higher than said lowest note and a right-hand keystroke window defined by a sound range from said highest note to a second note lower than said highest note;

chord identifying deciding means for determining whether the number of pressed keys in each of said keystroke windows is larger than a predetermined value to decide whether said each keystroke window is a chord identifying window effective in chord identification;

chord identifying means for identifying a chord on the basis of said pressed keys in said chord identifying window;

accompaniment pattern memory means having stored therein accompaniment patterns of rhythms corresponding to kinds of music;

accompaniment pattern readout means for reading out a selected one of said accompaniment patterns from said accompaniment pattern memory and for converting said read-out accompaniment pattern to said identified chord for outputting as an accompaniment chord control signal; and sound source control means for generating an accompaniment tone corresponding to said accompaniment chord control signal.

9. The device of claim 8, said keystroke window deciding means is means which sets a center key between said keys of the lowest and highest notes as a dividing point and defines the key at said dividing point as first and second notes.

10. The device of claim 8, wherein said keystroke deciding means includes means which decides a center key between said keys of the lowest and highest notes and defines, as said first note, a higher one of said center key and a key higher than said key of said lowest note by a first predetermined number of keys and, as said second note, a lower one of said center key and a key lower than said key of the highest note by a second predetermined number of keys.

11. The device of claim 8, wherein said keystroke window deciding means means which computes the concentration of said pressed keys other than said key of the lowest note with respect to the latter and the concentration of said pressed keys other than said key of the highest note with respect to the latter and decides said first and second notes so that one of said keystroke windows which is higher in concentration becomes larger than the other keystroke window.

12. The device of claim 11, wherein said keystroke window deciding means includes means for computing said concentrations as the reciprocal of the sum of the numbers of keys from said lowest notes to the notes of the other pressed keys and the reciprocal of the sum of the numbers of keys from said highest note to the notes of the other pressed keys.

13. The method of claim 11 or 12, wherein said keystroke window deciding means is means which decides a center key between said keys of the lowest and highest notes and whereby when said concentration with respect to said lowest note is larger than said concentration with respect to said highest note, the lower limit of said left-hand keystroke window is set to said key of lowest note, said first note is set to a higher one of said center key and a key at a position higher than said key of the lowest key by a first predetermined number of keys exceeding one octave, the upper limit of said right-hand keystroke window is set to said key of the highest note, and said second note is set to a higher one of said center key and a key at a position lower than said key of the highest note by a second predetermined number of keys exceeding one octave; and when said concentration with respect to said lowest note is smaller than said concentration with respect to said highest note, the lower limit of said left-hand keystroke window is set to said key of the lowest note, said first note is set to a lower one of said center key and a key at a position lower than said key of the highest note by said second number of keys, the upper limit of said right-hand keystroke window is set to said key of the highest note, and said second note is set to a lower one of said center key and a key at a position lower than said key of the highest note by said first number of keys.

14. The device of claim 8, wherein said chord identifying window deciding means includes setting means for setting a desired keystroke number.

* * * * *